United States Patent [19]

Prikkel, III

[11] 4,236,668

[45] Dec. 2, 1980

[54] THERMAL DAMPER ASSEMBLY HAVING POSITION CONTROLS

[76] Inventor: John Prikkel, III, 2952 Ensley Ave., Dayton, Ohio 45414

[21] Appl. No.: 927,135

[22] Filed: Jul. 21, 1978

[51] Int. Cl.[3] ..... F23N 3/00; F23L 3/00; G05D 23/00

[52] U.S. Cl. ..... 236/1 G; 236/93 R; 236/96; 431/20; 126/289; 126/292; 126/295

[58] Field of Search ..... 236/1 G, 49, 93 R, 96; 126/285 R, 289, 292, 295; 431/20

[56] References Cited

U.S. PATENT DOCUMENTS

| | | | |
|---|---|---|---|
| 2,975,975 | 3/1961 | Weber | 236/49 |
| 3,228,605 | 1/1966 | Diermayer et al. | 236/93 |
| 3,366,333 | 1/1968 | Diehl | 236/93 |
| 3,987,630 | 10/1976 | Hein et al. | 60/527 |
| 4,165,833 | 8/1979 | Nagel | 431/20 X |

FOREIGN PATENT DOCUMENTS

| | | | |
|---|---|---|---|
| 458924 | 8/1949 | Canada | 236/96 |
| 74643 | 1/1945 | Fed. Rep. of Germany | 126/285 R |

*Primary Examiner*—William E. Wayner
*Assistant Examiner*—Harry B. Tanner
*Attorney, Agent, or Firm*—Dybvig & Dybvig

[57] ABSTRACT

A thermal damper assembly mounted to substantially close a flue at room temperature is equipped with thermally responsive coils to move the damper to an open position in response to heat generated by combustion. To allow commencement of combustion the damper assembly is equipped with latch means to position the damper open in preparation for combustion, said latch means responding automatically to an adequate advance of said damper toward its fully open position to disable its own latching capability whereby said coils are permitted to substantially fully close the damper assembly without further attention to the latch means, which serves only to releasably position the damper assembly for commencement of combustion. Also illustrated in this application are various position control members for predetermining fully open and substantially fully closed damper positions. Also illustrated in this application are inboard and outboard mountings for the thermally responsive coils.

6 Claims, 9 Drawing Figures

FIG-1
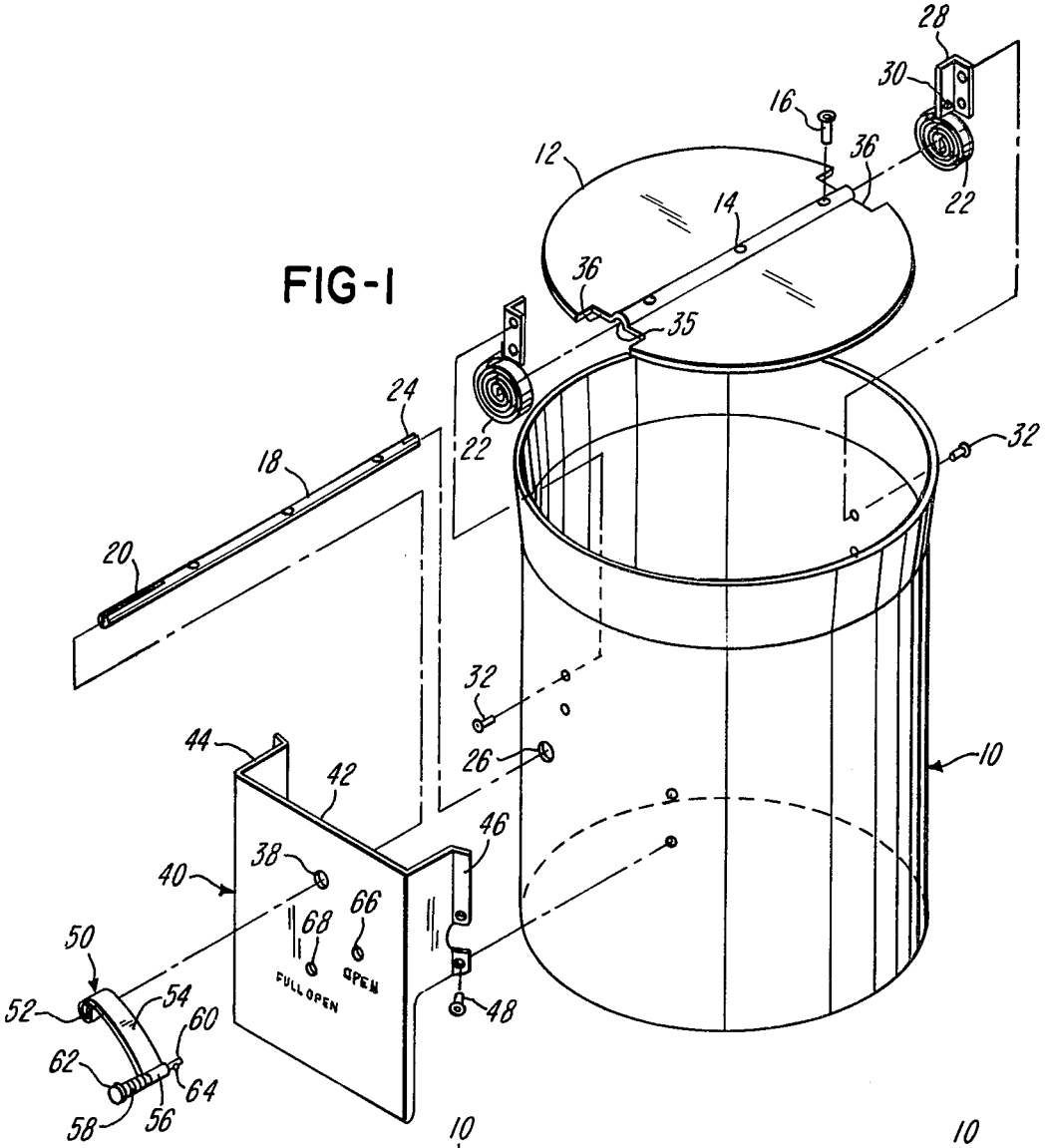
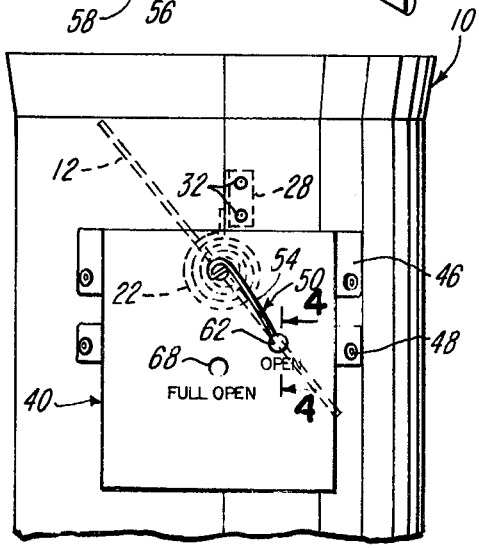
FIG-2
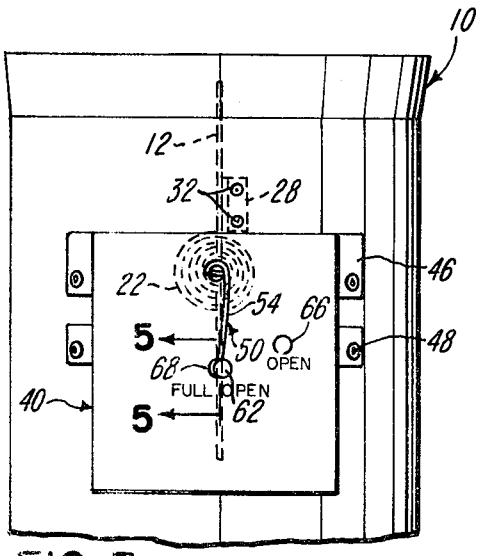
FIG-3

FIG-9
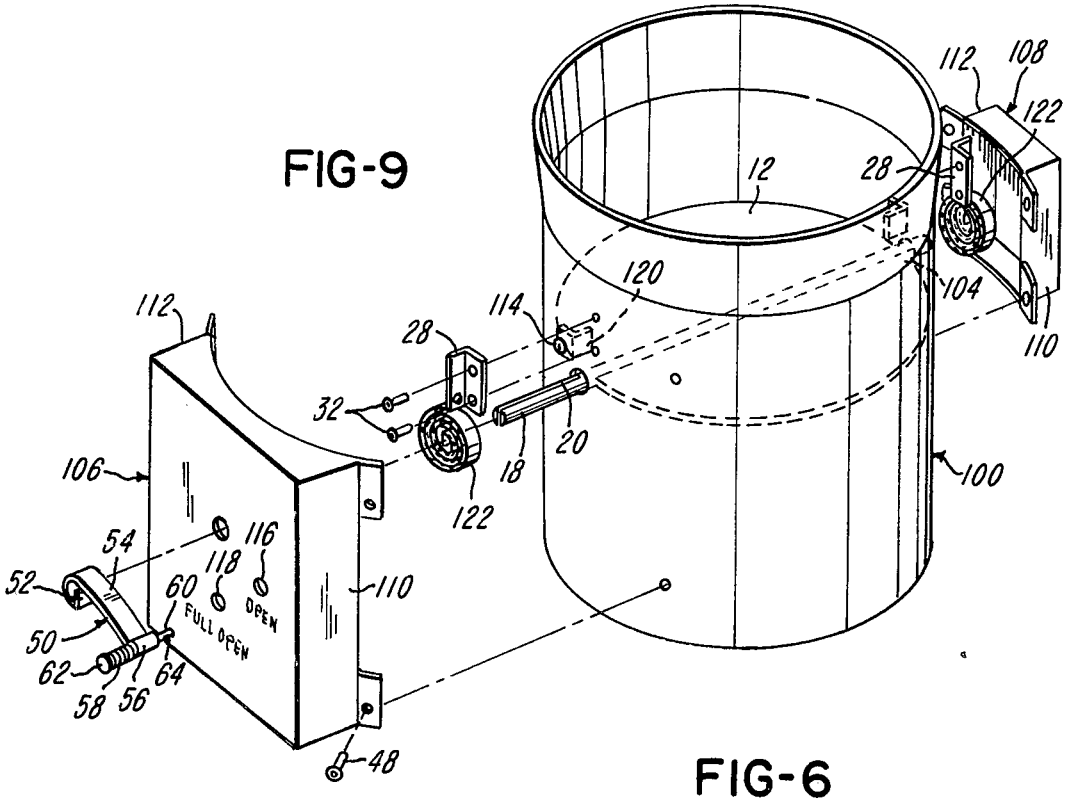
FIG-4
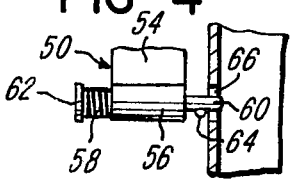
FIG-5
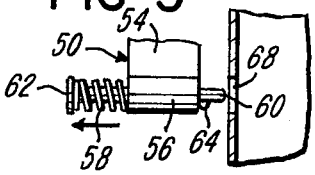
FIG-6
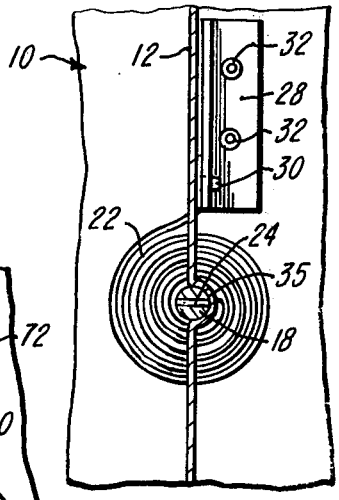
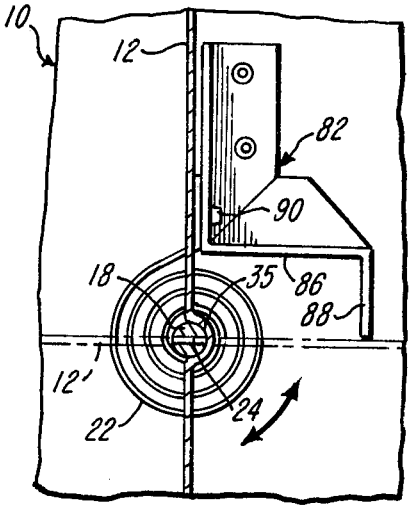
FIG-7
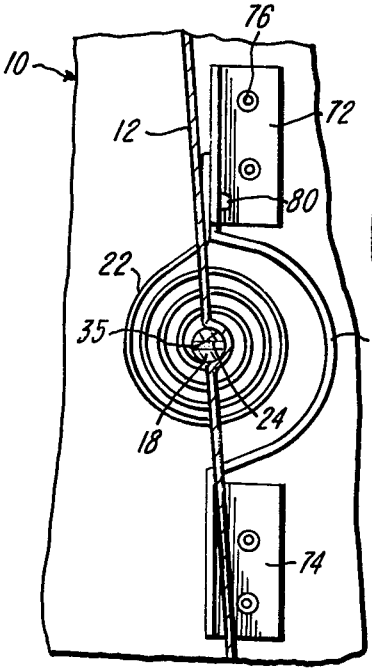
FIG-8

THERMAL DAMPER ASSEMBLY HAVING POSITION CONTROLS

BACKGROUND OF THE INVENTION

1. Field of the Invention

This invention relates to thermally operated flue dampers having position controls and more particularly to such flue dampers equipped with self-disabling damper opening latch means of a type especially suitable for use in various combustion devices including wood burning stove devices.

2. Prior Art

Thermally operated ventilation control mechanisms are known in the prior art, an example appearing in U.S. Pat. No. 2,975,975 issued Mar. 21, 1961, to E. L. Weber. The mentioned Weber patent discusses bimetallic thermally responsive operators or coils. A flue damper utilizing a bimetallic coiled device also appears in U.S. Pat. No. 3,366,333 issued Jan. 30, 1968, to C. G. Diehl. U.S. Pat. No. 3,987,630 is a teaching of a thermally responsive coil not requiring a bimetallic composition.

SUMMARY OF THE PRESENT INVENTION

Difficulties with thermally operated flue dampers of the prior art are that some dampers lack an adequate flue opening position control for use in commencing combustion and also no provision is made for preventing a damper overshoot during vigorous combustion. In the present invention the damper assembly departs from much of the prior art in being a normally closed damper assembly at those temperatures generally regarded as room temperatures. The operation of the damper is controlled by thermally responsive coil devices which rotate the damper toward a fully open position with increasing temperatures. To allow combustion to be commenced before the thermal conditions which open the damper come into existence, the damper assembly of the present invention is equipped with latch means allowing an attendant to manually latch the damper in an adequately open position before the commencement of combustion, such latch means being self-disabling in response to continued combustion so that the damper which has been latched to an open position may later close itself as the continuing combustion dies away. To achieve this self-disabling function the latch means is equipped with a disabling spring whose operation is over-ridden by frictional or interference phenomena until such time as the thermal response of the damper assembly warrants the damper opening established by the latch means whereupon the friction or interference phenomena overpowering the latch spring are relieved.

In various modifications damper positioning means are disclosed for predetermining a maximum open position for the damper, the latter position preventing an overshoot of the damper toward a closing position when exposed to increasing temperatures.

In one embodiment the damper assembly is equipped with thermally responsive coils mounted inboard of a flue duct.

In a modification the thermally responsive coils are mounted outboard of the flue duct and shielded so as to adjust the temperature range in which the thermally responsive elements operate.

It is accordingly an object of the present invention to provide a new and improved thermally responsive damper assembly.

Another object of the present invention is to provide a thermally responsive damper assembly which is normally closed at room temperatures and latch means for temporarily holding the damper in an adequately open position in preparation for commencement of combustion, said latch means being self-disabling following continuing combustion.

Another object of the present invention is to provide a thermally responsive damper assembly having damper positioning means effective to resist an overshoot of the thermally responsive damper in consequence of vigorous combustion.

BRIEF DESCRIPTION OF THE DRAWINGS

In the drawings, FIG. 1 is an exploded perspective view illustrating a thermal damper control in accordance with the present invention.

FIG. 2 is an elevation view, with a portion broken away, illustrating the thermal damper control in a first operating position.

FIG. 3 is an elevation view, with a portion broken away, illustrating a second operating position.

FIG. 4 is a fragmentary section view taken substantially along the line 4—4 of FIG. 2 and showing an enabled latch.

FIG. 5 is a section view taken substantially along the line 5—5 of FIG. 3 and showing a disabled latch.

FIG. 6 is a fragmentary section view taken transversely through a damper plate positioned by the damper control.

FIG. 7 is a fragmentary section view analgous to FIG. 6 illustrating a first modification.

FIG. 8 is a fragmentary section view analgous to FIG. 6 illustrating a second modification.

FIG. 9 is an exploded perspective view illustrating a third modification.

DESCRIPTION OF THE PREFERRED EMBODIMENTS

Referring to FIG. 1 there is shown a tube or duct 10 adapted for insertion into the flue of a combustion apparatus such as a wood burning stove. The upper margin of the duct is tapered outwardly so that condensed combustion products will not readily leak outwardly from higher portions, not shown, of the flue. Mounted for pivotal movements within the duct 10 is a damper plate 12, said damper plate having a generally circular configuration in conformity with the generally cylindrical shape of the duct 10.

Affixed to the damper plate 12, as by rivets 16 entering appropriately located apertures 14, is a shaft 18 extending diametrically across the center of the damper plate 12. The shaft 18 is greater in length than the diameter of the damper plate 12 so as to have one end extending radially outwardly from the damper plate 12, such end being bifurcated by means of an axially disposed slot 20. The opposite end of the shaft 18 terminates within the circular shape of the damper plate 12 and is also bifurcated by a slot 24.

The slots 20 and 24 each slidably receive the innermost convolution of a spirally shaped coil 22. The outermost convolutions of the coils 22 are secured, as by means of rivets 30, each to one flange of an angle bar 28, the two angle bars serving as mounting brackets for the coils 22.

The coils 22 may each comprise a single homogenous metal or, alternatively, a bimetallic assembly formed of laminated or otherwise facially attached layers of differing composition. In either event the coils so perform that, upon a temperature increase the coils expand lengthwise, and upon a temperature change in the opposite direction, the coils contract. It will be appreciated by those skilled in the art that as the coils 22 expand, the coils will each open to a larger diameter.

The brackets 28 are secured into the surrounding wall of the duct 10 by means of rivets 32, the rivets 32 securing the brackets against rotation within the duct 10. By reason of rivets 30 securing the outer convolution of the coils 22 against rotation about the axis of the shaft 18, all rotation resulting from thermal expansion is transmitted to the shaft 18 and damper plate 12.

As can be noted in FIG. 1 the damper plate 12 may be formed with a trough 35 which accommodates the peripheral shape of the shaft 18 so that the shaft is snugly secured to the damper plate 12 by means of the aforementioned rivets 16. The periphery of the damper plate 12 is provided with approximately rectangular notches 36 at the ends of the trough 35. The notches 36 accommodate the dimensions of the coils 22.

The length of the shaft 18 is such that the notch 24 at the end thereof slidably fits the innermost convolution of the right-hand coil 22 and the relatively longer notch 20 slidably receiving the left-hand coil 22 forms an outboard extension of the shaft 18 passing through the aperture 26 located in the wall of the duct 10. The outboard extension of the shaft 18 also passes through an aperture 38 located in a protective shield 40.

The shield 40 comprises a generally planer outer face 40 flanked on opposite side edges by side arms 44 which function to space the face 42 slightly away from the outside surface of the duct 10. The side arms 44 have integrally formed flanges 46 which are suitably perforated to receive rivets 48 entering appropriately located apertures in the wall of the duct 10, the rivets 48 cooperating to support the aperture 38 in coaxial alignment with the aperture 26.

The outboard extension of the shaft 18 is diamensionally sufficient that the left-hand end of the shaft, bifurcated by the slot 20, projects through the face 42 to slidably engage a slide 52 formed by inwardly turning one end of a latch 50. The latch 50 includes an outwardly extending arm 54 having its outer end 56 turned cylindrically inwardly to receive a pin 60. The pin 60 has a head 62 trapping a spring 58 between the head 62 and the outer end 56 of the latch 50. The pin 60 is swaged at the right-hand end thereof as it appears in FIG. 1, to form an outwardly projecting lug 64 which cooperates with the head 62 to positively entrap the spring 58.

It will be noted that the slide 52, which is integral with the latch 50, causes the latch 50 and the shaft 18 to rotate in unison about the axis of the shaft 18. Inasmuch as the shaft 18 is restrained as to rotation by its sliding fit with the innermost convolutions of the coils 22 and the latch 50 is also restrained against rotation about the shaft 18, it can be appreciated that the latch arm 54 will at any given temperature, such as room temperature, extend outwardly from the shaft 18 in a particular direction. It is preferred that the direction in which the arm 54 projects away from the shaft 18 be generally parallel to the plane of the damper plate 12, thus the direction in which the arm 54 points is an indication of the rotary position of the damper plate 12.

The coils 22 are so formed that when engaged into the slots 20 and 24 in the fashion described, and when latch 50 is engaged in the slot 20 as described, the plane of the damper plate 12 will be generally perpendicular to the axis of the duct 10 at room temperature and, correspondingly, the arm 54 will be generally parallel to the plane of the damper plate 12. The damper plate 12 is sized to be only slightly smaller than the inside diameter of the duct 10, with the result that the damper plate 12 can rotate to a horizontal position in which the periphery of the damper plate cooperates with the inside wall of the duct 10 to substantially close the duct 10 without frictional rubbing of the damper plate 12 against the inside wall of the duct 10.

In view of the foregoing description, it can be appreciated that at room temperature (72° F., 22° C.) the duct 10 is substantially but not entirely plugged by the damper plate 12 functioning in cooperation with the coils 22. Thus the room temperature condition of the assembly is a substantially closed condition.

One can assume the duct 10 to be included in the flue assembly for a wood burning stove. In a room temperature atmosphere and thus when the occupants of the household are not desirous of supplemental heat, the herein described damper structure will be substantially closed, although, of course, precise location of the damper plate 12 will vary modestly depending upon the temperature condition of the household.

Assuming the household occupants have a desire for greater heat, a fire may be commenced in the wood burning stove. However, since the damper plate 12 will be in a position substantially closing the duct 10, this being a condition notable by the position of the arm 54, the individual igniting the fire will first manually rotate the arm 54 to the indicated open position, whereat the pin 60 will enter an aperture 66 located in the face 42, such manual rotation of the arm 54 developing a restoring torque in the coils 22, with the consequence that the swaged end of the pin 60 will be restrained against the retractive action of the spring 58. Such restraint may be augmented, or rendered more positive, by the shape of the lug 64 which projects outwardly from the pin 60. However, the mere existence of friction between the pin 60 and the margins of the face 42 surrounding the aperture 66 will ordinarily be sufficient to resist the tendency of the spring 58 to retract the pin 60 from the aperture 66.

Assuming the damper plate 12 to have been positioned to an open position by a rotation of the latch 50 which permits the pin 60 to be pressed into the aperture 66, the damper plate 12 will be in the open position indicated by broken lines in FIG. 2. Upon the ignition of a fire which causes heated gases to flow upwardly in the duct 10 so as to transfer heat to the coils 22, the expansion of the metal of the coils will cause a rotation of the innermost convolutions of the coils 22 with respect to the outermost convolutions of such coils, such as to drive the damper plate 12 in the clockwise direction as appears in FIG. 2. Thus the heating of the coils 22 thermally drives the damper plate 12 in the same direction as this plate was rotated manually just prior to ignition of the fire. With a continued heating of the coils 22, the bias of such coils tending initially to rotate the damper plate 12 to its horizontal duct closing position is lost and, in fact, expansion of the coils 22 drives the damper plate 12 further in the clockwise direction as it appears in FIG. 2, thus relieving the forces which have been locking the pin 60 to the surrounding wall of the aperture 66. The spring 58 thereupon retracts the pin 60 from the aperture 66 with the result that the position of the damper plate 12 is thereafter determined solely by the thermal condition of the coils 22. This means, of course, that a fire vented by the mechanism of the present invention, after being commenced by a manual setting of the damper plate 12, is freed of the manual setting once the fire burns briskly and can be permitted to die away without further supervision or intervention and, as the fire dies away, the coils 22 responding to the diminishing temperature conditions, will gradually close the duct 10 as the fire dies away.

Depending upon atmospheric conditions and most particularly the draft available to the flue assembly utilizing the present invention, it may prove expedient to commence the fire with the damper plate 12 in a fully open position, i.e. a position in which the plane of the damper plate 12 is substantially parallel to the longitudinal axis of the duct 10 and for this purpose the face 42 of the shield 40 is provided with a second aperture 68 designated "full open" in FIG. 1. With this setting a fire can be ignited under conditions affording a maximum draft and, when the fire is burning fully, the thermal expansion of the coils 22 can serve to drive the damper plate 12 to the fully open position, with the consequence that the pin 60 is retracted and as the fire dies away the damper plate 12 will again progressively close the duct 10. FIG. 3 illustrates the damper plate 12 in such "full open" position.

As the foregoing discussion indicates, a possibility exists that a fire burning too vigorously can drive the damper plate 12 past the "full open" position whereupon the damper tends to restrict the venting of the gases sought to be vented. This condition is prevented in the first embodiment herein described by the configuration of the angle bars 28 which are so located by their rivets 32 as to restrict the travel of the damper plate 12 to the position wherein the plane of the damper plate 12 is parallel to the central axis of the duct 10. The "full open" aperture 68 is accordingly located somewhat away from the full open damper position so as to allow the action of the coils 22 exposed to a high heat to release the pin 60.

FIG. 7 illustrates a modification in which the angle bar 28, illustrated in the preferred embodiment, has been formed by cutting and bending an extrusion formed initially in the shape of an angle bar to produce a position stop 82 for determining initial and final positions of the damper plate 12. The stop 82 as illustrated in FIG. 7 has an upstanding angle bar portion and, a horizontally disposed angle bar 86 from which one flange only, the illustrated flange 88, extends downwardly. Except for this modification in the configuration of the angle bar, the modification of FIG. 7 may be identical in construction to the preferred embodiment and, accordingly, the reference numbers of the preferred embodiment identifying unmodified portions of this modification are employed.

As indicated by the arrow appearing in FIG. 7 the damper plate 12 is urged by the coils 22 to rotate in a clockwise direction with increasing temperature. The solid lines in FIG. 7 thus illustrate the damper assembly when exposed to a high heat which has advanced the damper plate 12 to a position wherein the plane occupied by the damper is parallel to the longtitudinal axis of the duct 10. FIG. 7 also illustrates with broken lines the position reached by the damper plate 12 upon cooling substantially to room temperature, whereupon the horizontal position of the damper plate 12 is determined by engagement of the damper plate 12 against the flange 88. The shaped angle bar portion 82 thus limits the travel of the damper plate 12 to an approximate 90° arc from the broken line position illustrated in FIG. 7 clockwise to the solid line position illustrated in FIG. 7.

This modification offers the advantage that the damper plate 12 can be designed to a room temperature condition in which the damper plate 12 substantially closes the duct 10 and limited to a high temperature position in which the damper plate abuts the rivet 90 securing the coil 22. Should the fine temperature exceed the temperature required to bring the damper plate 12 to the solid line position illustrated in FIG. 7, it will not be possible for such a high temperature to carry the damper plate beyond the "full open" position.

FIG. 8 illustrates a second modification of the present invention in which only the stop means which limit the travel of the damper plate in response to elevated temperatures has been changed and accordingly reference numbers which identify parts unmodified in relation to the preferred embodiment in FIG. 1 have not been changed. In this modification an elongated stop member formed initially as an extruded angle bar has had one of its flanges 70 curved about the adjacent coil 22, thus to form spaced apart angle bar portions 72 and 74 each secured by rivets 76. As illustrated, the damper plate 12 is permitted movement from its illustrated position counterclockwise through an angle somewhat less than 180°. In this modification the room temperature condition for the damper plate 12 will preferably be a horizontal position and accordingly FIG. 8 illustrates the condition of the coils 22 at an elevated temperature.

FIG. 9 illustrates a modification in which thermally responsive coils 122 have been mounted outboard of a modified duct 100 rather than inboard as was the case with the preferred embodiment of FIG. 1. To accomplish such assembly the shaft 18 is sufficiently long to cause the shaft to entirely traverse a duct 100. The duct 100 has been modified as compared to the duct 10 by the provision of a second aperture 104 diametrically opposite an aperture, such as aperture 26, already existing in the duct 100. Thus the duct 100, with its diametrically disposed apertures, permits the shaft to project outboard of diametrically opposite portions of the duct 100 for receipt of coils 122 riveted to angle bar positioning devices 120 which in turn are riveted by such means as rivet 114 to outboard surface portions of the duct 100. This modification also employs modified shields 106 and 108 which differ from the shield 40 of the preferred embodiment in having alongated side walls 110 bridged by arcuate side walls 112 which cooperate with outboard surfaces of the duct 100 to fully enclose the coils 122 in their outboard location. This full enclosure of the coils 122 which is substantially complete except for latch position apertures such as the apertures 116 and 118 illustrated in FIG. 9, offers the advantage that the coils 122 which are now located in outboard positions are shielded from direct exposure to the hot gases upflowing the duct 100 and accordingly the temperature range in which the coils 122 operate is reduced. This reduction in the operating temperature range can, of course, be compensated by the design of the coils 122. Accordingly, the coils 122 are illustrated in FIG. 9 as being coils formed by bonding together differing metals and thus as being bimetallic coils. Such bimetallic coils which operate as a result of a larger expansion of the material on one surface of the coil as opposed to a different material on the opposite surface of the coil are capable of responding more vigorously to temperature changes and accordingly can be designed to operate in a lower temperature.

The modification of FIG. 9 offers the further advantage that the coils 122 may be formed of materials which melt at lower temperatures.

While it is preferred that the coils 22 and 122 illustrated and described herein be fabricated of commonly available metals, such as aluminum and tin, those skilled in the art will appreciate that the invention is not limited to such commonly available metals and furthermore is not limited to coils which are of a metallic composition.

Although the preferred embodiments have been described, it will be understood that various changes may be made within the scope of the appended claims.

Having thus described my invention, I claim:

1. A thermally responsive damper assembly adapted for mounting in a flue which vents gases from a region in which combustion is to occur comprising, in combination, generally cylindrical duct means for mounting in communication with said flue, a damper plate having a generally circular periphery interrupted by diametrically disposed notches, a pair of thermally responsive coil elements disposed inboard of said duct means, one disposed in each of said notches, means for drivingly connecting an inner convolution of each of said coil elements to said damper plate, and means for drivingly connecting an outer convolution of each of said coil elements to said duct means so that all rotation resulting from thermal expansion or contraction of said coil elements is transmitted to said damper plate, said coil elements supporting said damper plate in said duct means, said coil elements positioning said damper plate in a duct means closing position when exposed to room temperatures, said means for drivingly connecting an outer convolution of each of said coil elements to said duct means including means engagable with said damper plate for preventing an over travel of said damper plate beyond a duct means opening position.

2. A thermally responsive damper assembly adapted for mounting in a flue which vents gases from a region in which combustion is to occur comprising, in combination, duct means for mounting in communication with said flue, a damper plate, at least one thermally responsive coil element, means for drivingly connecting an inner convolution of said coil element to one of said duct means and said damper plate, means for drivingly connecting an outer convolution of said coil element to the other of said damper plate and said duct means, said coil element supporting said damper plate in a duct means closing position when exposed to room temperatures, one of said means drivingly connecting said coil element including means for preventing an over travel of said damper plate beyond a duct means opening position, and latch means operable to displace said damper plate from its duct means closing position in preparation for combustion.

3. The combination of claim 2 wherein said latch means includes self-retracting pin means for disabling said latch means following the occurrence of a combustion adequate to thermally activate said coil element and therewith said damper plate to the open position established by said latch means.

4. A thermally responsive damper assembly adapted for mounting in a flue comprising, in combination, a duct for mounting in communication with said flue, a shaft traversing said duct, one end of said shaft projecting outboard of said duct, a damper plate affixed to said shaft inboard of said duct, a pair of thermally responsive yieldable elements engaging opposite end portions of said shaft, bracket means mounting said yieldable elements to said duct, shield means mounted to an outboard surface of said duct and having a first aperture receiving said outboard end of said shaft, latch means drivingly engaged to said outboard end, said shield means having a second aperture, pin means for entering said second aperture, and spring means coacting between said latch means and said pin means for retracting said pin from said second aperture, said latch means being manually movable against a bias from said yieldable elements for frictionally engaging said pin means in said second aperture, said frictional engagement resisting retraction of said pin means by said spring means except at elevated flue temperatures.

5. In a thermally responsive damper assembly of the type adapted for mounting to a flue which vents gases from a region in which combustion is to occur, said damper assembly comprising a generally cylindrical duct for mounting in communication with said flue, and a damper plate having a generally circular periphery of diameter less than the inside diameter of said duct, the improvements wherein said generally circular periphery of said damper plate is interrupted by a pair of diametrically disposed notches, including a pair of thermally responsive coil elements, one received in each of said notches, including means for drivingly connecting an inner convolution of each of said coil elements to said damper plate, including a pair of bracket members, including means affixing a portion of each of said bracket members to the inside wall surface of said duct, wherein said bracket members are affixed to diametrically opposite portions of said inside wall surface, wherein each of said bracket members has a flange portion projecting inwardly of said duct from said inside wall surface, there being one flange portion for each of said coil elements, affixing the outer convolutions of said coil elements to said flange portions, said bracket members being so located at the inside wall surface of said duct that the coil elements affixed thereto are positioned in the notches of said damper plate and the inner convolutions of said coil elements cooperate with said means for drivingly connecting the inner convolutions of said coil elements to support said damper plate, when said coil elements are exposed to room temperatures, for substantially completely closing said duct and, when said coil elements are exposed to a higher temperature for substantially completely opening said duct, the projection of at least one of said flange portions inwardly of said duct being of sufficient extent that the circular periphery of said damper plate is driven toward abutment with said one flange portion as said coil elements respond to sufficiently elevated temperatures.

6. A thermally responsive damper assembly comprising, in combination, duct means for mounting in communication with a flue, a damper plate disposed inboard of said duct means, shaft means affixed to said damper plate, a shaft portion of said shaft means projecting outboard of said duct means, a pair of thermally responsive yieldable elements, said yieldable elements disposed inboard of said duct means and affixed to said shaft means at opposite peripheral portions of said damper plate, bracket means attaching said yieldable elements to said duct means, said duct means including outboard face means having a first aperture receiving said outboard projecting shaft portion, latch means drivingly engaged to said outboard projecting shaft portion, said outboard face means having a second aperture, a latch pin for entering said second aperture, and spring means co-acting between said latch means and said latch pin for retracting said latch pin from said second aperture, said latch means being manually movable against a bias from said yieldable elements for engaging said latch pin in said second aperture.

* * * * *

UNITED STATES PATENT AND TRADEMARK OFFICE

CERTIFICATE OF CORRECTION

PATENT NO. : 4,236,668

DATED : December 2, 1980

INVENTOR(S) : JOHN PRIKKEL, III

It is certified that error appears in the above-identified patent and that said Letters Patent are hereby corrected as shown below:

Column 6, line 9, "fine" should be ---flue---

Signed and Sealed this

Third Day of March 1981

[SEAL]

Attest:

RENE D. TEGTMEYER

Attesting Officer

Acting Commissioner of Patents and Trademarks